US010386783B2

(12) United States Patent
Hattori et al.

(10) Patent No.: US 10,386,783 B2
(45) Date of Patent: Aug. 20, 2019

(54) GROUNDING STRUCTURE FOR ELECTRICALLY GROUNDING EQUIPMENT AND IMAGE FORMING APPARATUS INCLUDING THE SAME

(71) Applicant: KYOCERA Document Solutions Inc., Osaka (JP)

(72) Inventors: Mitsuki Hattori, Osaka (JP); Yoshifumi Okauchi, Osaka (JP); Kazuhisa Hirahara, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/161,740

(22) Filed: Oct. 16, 2018

(65) Prior Publication Data

US 2019/0113883 A1 Apr. 18, 2019

(30) Foreign Application Priority Data

Oct. 18, 2017 (JP) ..... 2017-202055

(51) Int. Cl.
*G03G 21/16* (2006.01)
*H01R 4/48* (2006.01)

(52) U.S. Cl.
CPC ..... *G03G 21/1647* (2013.01); *G03G 21/1652* (2013.01); *H01R 4/4872* (2013.01); *G03G 2221/166* (2013.01); *H01R 2201/06* (2013.01)

(58) Field of Classification Search
CPC ..... G03G 21/1647; G03G 21/1652; G03G 2221/166; H01R 4/4872; H01R 2201/06
See application file for complete search history.

(56) References Cited

U.S. PATENT DOCUMENTS 6,173,145 B1 * 1/2001 Chadani ..... G03G 15/0935 399/265
6,351,620 B1 * 2/2002 Miyabe ..... G03G 21/1853 399/111
2006/0066675 A1 * 3/2006 Ito ..... B41J 2/14201 347/50
2006/0105142 A1 * 5/2006 Shiga ..... C09J 7/22 428/136
2010/0330817 A1 * 12/2010 van Ekstrom ..... G10H 1/32 439/32
2018/0238834 A1 * 8/2018 Sekiguchi ..... G01N 29/041

FOREIGN PATENT DOCUMENTS

JP 2008-195527 8/2008

* cited by examiner

*Primary Examiner* — Joseph S Wong
(74) *Attorney, Agent, or Firm* — Wenderoth, Lind & Ponack, L.L.P.

(57) ABSTRACT

An grounding structure of an equipment includes a coil spring provided between a first member of an equipment side and a second member, which includes a metal plate member, of a ground side, wherein the first member and the second member are disposed opposite to each other, one end of the coil spring is brought into press contact with the first member, and the other end of the coil spring is brought into press contact with the second member. An engraved groove is formed at an abutting point of the second member with the coil spring, and is formed such that at least a part of a convex burr part generated along an end edge of the engraved groove abuts the other end of the coil spring.

7 Claims, 7 Drawing Sheets

GROUNDING STRUCTURE FOR ELECTRICALLY GROUNDING EQUIPMENT AND IMAGE FORMING APPARATUS INCLUDING THE SAME

CROSS-REFERENCE TO RELATED APPLICATION

This application is based upon and claims the benefit of priority from Japanese Patent Application No. 2017-202055 filed on Oct. 18, 2017, the entire contents of which are incorporated herein by reference.

BACKGROUND

The technology of the present disclosure relates to a grounding structure for electrically grounding an equipment and an image forming apparatus including the same.

In the related art, there has been known a grounding structure for electrically grounding an equipment, which is installed at an image forming apparatus and the like, by a metallic coil spring.

As an example of such a grounding structure, there has been proposed a structure in which a coil spring is disposed between a first member of an equipment side and a second member, which includes a metal plate member, of a ground side, wherein one end of the coil spring is brought into press contact with the first member and the other end of the coil spring is brought into press contact with the second member.

SUMMARY

A grounding structure of an equipment according to one aspect of the present disclosure includes a coil spring. The coil spring is provided between a first member of an equipment side and a second member, which includes a metal plate member, of a ground side, wherein the first member and the second member are disposed opposite to each other. One end of the coil spring is brought into press contact with the first member. The other end of the coil spring is brought into press contact with the second member.

An engraved groove is formed at an abutting point of the second member with the coil spring. The engraved groove is formed such that at least a part of a convex burr part generated along an end edge of the engraved groove abuts the other end of the coil spring.

DETAILED DESCRIPTION

Hereinafter, an example of an embodiment will be described in detail on the basis of the drawings. It is noted that the technology of the present disclosure is not limited to the following embodiments.

Embodiment

Figure 1:
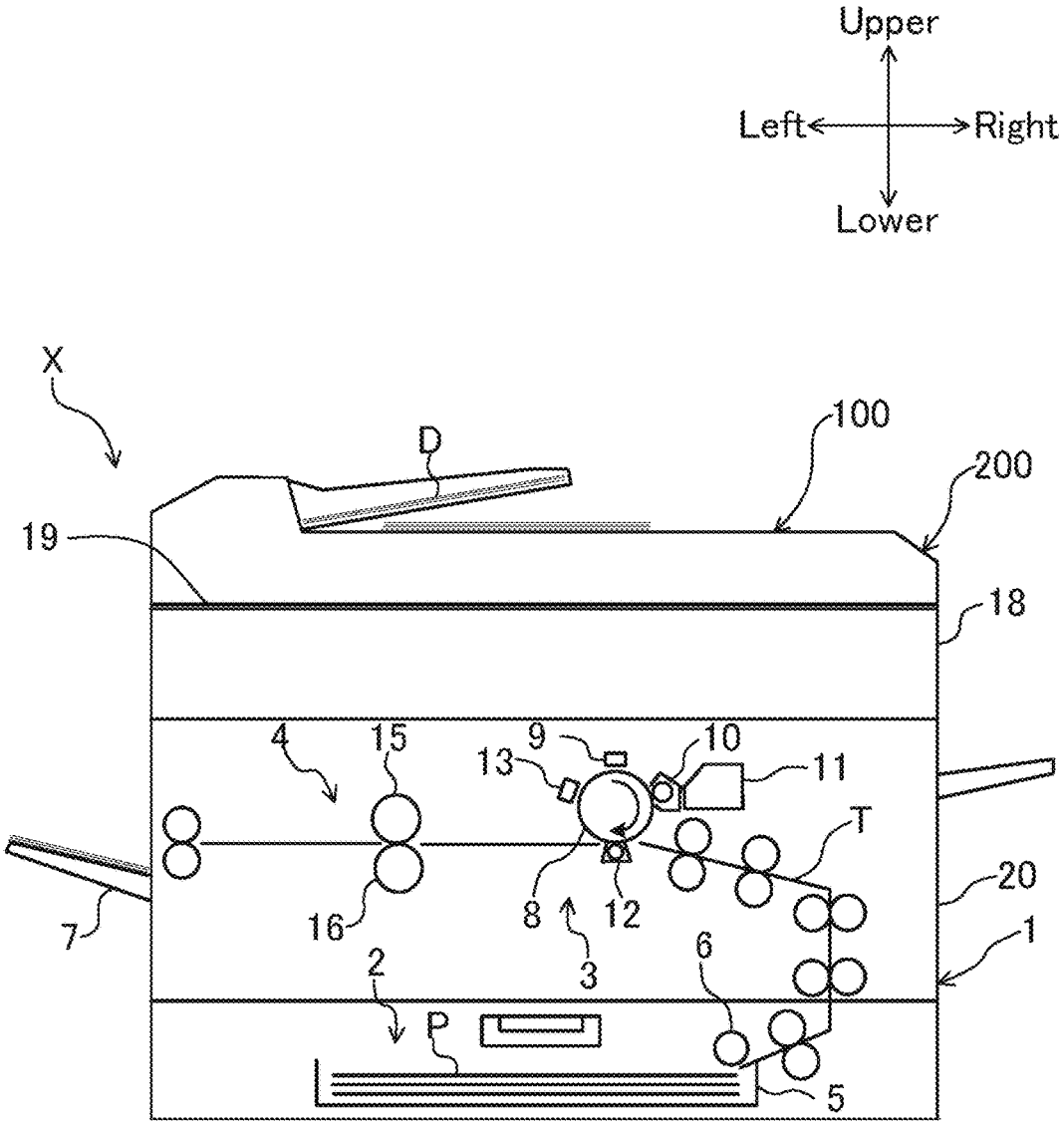
FIG. 1 is a schematic configuration view illustrating an image forming apparatus including a grounding structure of an image reading device (an equipment) in an embodiment.

FIG. 1 illustrates an image forming apparatus X including an image reading device 200 (an example of an equipment) having a document conveying device 100 in an embodiment. It is assumed that the image forming apparatus X is a copy machine that prints a document image read by the image reading device 200. The image forming apparatus X is not limited to the copy machine and may be a facsimile, a multifunctional peripheral (MFP) capable of performing a plurality of kinds of jobs, and the like.

The image reading device 200 is disposed at an upper side of an image forming apparatus body 1. The image forming apparatus body 1 has a rectangular box-like body housing 20, and the body housing 20 receives a sheet feeding unit 2, an image forming unit 3, and a fixing unit 4 therein. The body housing 20, for example, is configured by a metal plate member such as a SGCC. The SGCC is a material based on a cold rolled steel sheet of hot dip galvanized steel sheets.

The sheet feeding unit 2 has a sheet feeding cassette 5 that stores a plurality of sheets P stacked in a bundle shape, and a pick-up roller 6 that takes out the sheets P in the sheet feeding cassette 5 one by one and supplies the taken-out sheets P to a predetermined sheet conveyance path T. The sheet conveyance path T extends upward from the sheet feeding unit 2, extends in a horizontal direction, and then is connected to a document discharge tray 7.

The image forming unit 3 includes a photosensitive drum 8, a charging device 9, a developing device 10, a toner container 11, a transfer roller 12, and a charge eliminating device 13. In the image forming unit 3, an image is formed on the sheet P, which is supplied from the sheet feeding unit 2, in the following procedure. Specifically, the charging device 9 charges the photosensitive drum 8 to a predetermined potential, first. Next, light based on image data is emitted to a surface of the photosensitive drum 8 from a laser scanning unit (LSU; not illustrated). In this way, an electrostatic latent image is formed on the surface of the photosensitive drum 8. Then, the developing device 10 supplies toner to the electrostatic latent image on the photosensitive drum 8, thereby developing the electrostatic latent image. The transfer roller 12 is rotated in press contact with the surface of the photosensitive drum 8 while interposing the sheet P between the transfer roller 12 and the photosensitive drum 8. In this case, since a transfer voltage is applied to the transfer roller 12, a toner image on the surface of the photosensitive drum 8 is transferred to the sheet P. The charge eliminating device 13 eliminates charge on the surface of the photosensitive drum 8 after the toner image is transferred to the sheet P.

The fixing unit 4 has a fixing roller 15 and a pressure roller 16 brought into press contact with each other. The fixing roller 15 has a heater therein. The fixing unit 4 conveys the sheet P while interposing the sheet P between the fixing roller 15 and the pressure roller 16, and heats and pressurize the toner image, thereby fixing the toner image to the sheet.

The image reading device 200 has a rectangular box-like scanner housing 18 placed on the upper side of the image forming apparatus body 1, and the document conveying device 100 mounted on the upper surface of the scanner housing 18.

The scanner housing 18 is configured by a metal plate member. As the metal plate member, the SGCC and the like can be employed similarly to the body housing 20.

On the upper surface of the scanner housing 18, a contact glass 19 is mounted. The scanner housing 18 receives therein a reading unit (not illustrated) that has a light source and can move in a sub-scanning direction (a right and left direction of FIG. 1). The reading unit emits light from the light source toward a document D placed on the contact glass 19 or a document D conveyed on the contact glass by the document conveying device 100. The reading unit reads reflected light thereof by an image sensor to read an image of one side surface of the document D, thereby generating image data of the image.

Figure 2:
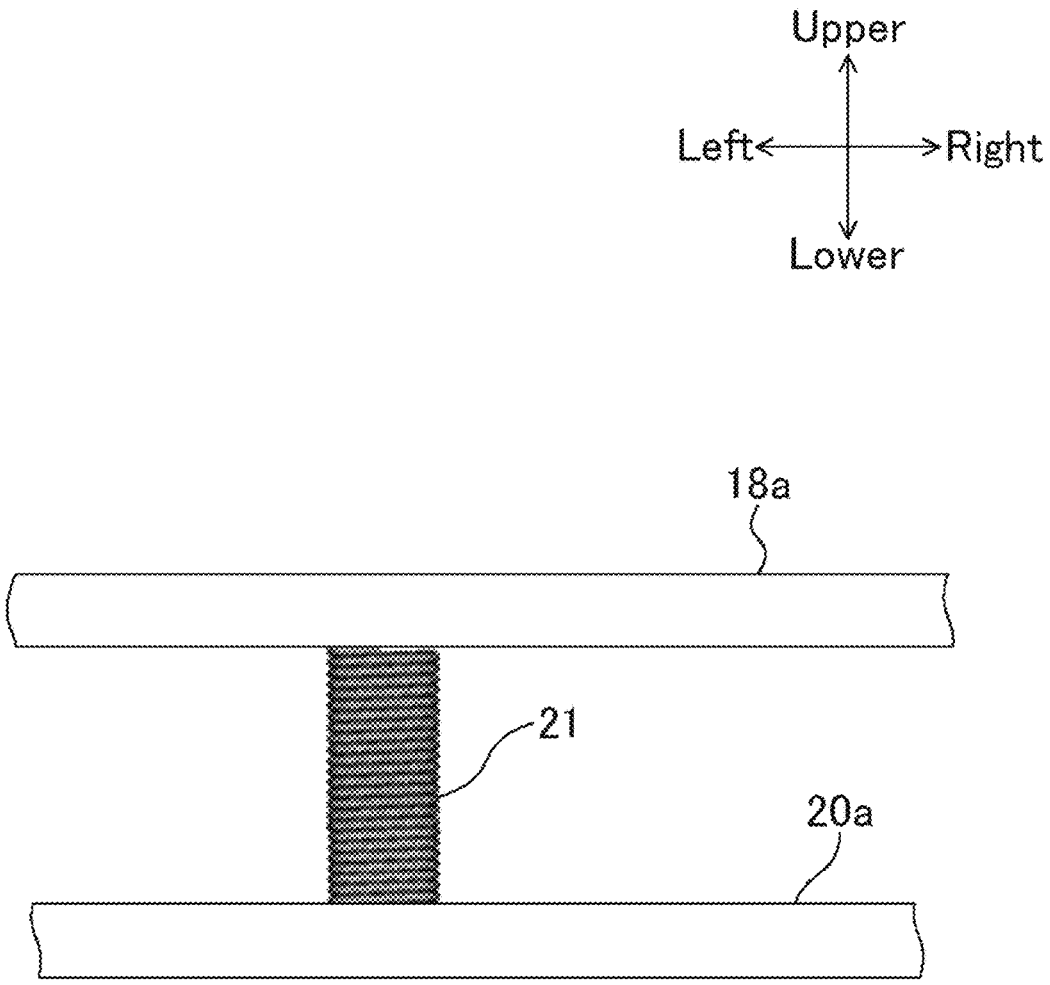
FIG. 2 is a schematic side view illustrating a grounding structure of an image reading device with respect to an image forming apparatus body.

As illustrated in FIG. 2, a bottom wall metal plate 18*a* (an example of a first member of the equipment side) of the scanner housing 18 is disposed opposite to an upper wall metal plate 20*a* (an example of a second member of the ground side) of the body housing 20. The bottom wall metal plate 18*a* is electrically grounded to the upper wall metal plate 20*a* via a coil spring 21. The coil spring 21 is interposed and compressed between the bottom wall metal plate 18*a* and the upper wall metal plate 20*a*. By so doing, an upper end of the coil spring 21 is brought into press contact with the bottom wall metal plate 18*a* and a lower end of the coil spring 21 is brought into press contact with the upper wall metal plate 20*a*. Both an upper end surface and a lower end surface of the coil spring 21 are non-grinding surfaces (surfaces not subjected to grinding).

Figure 3:
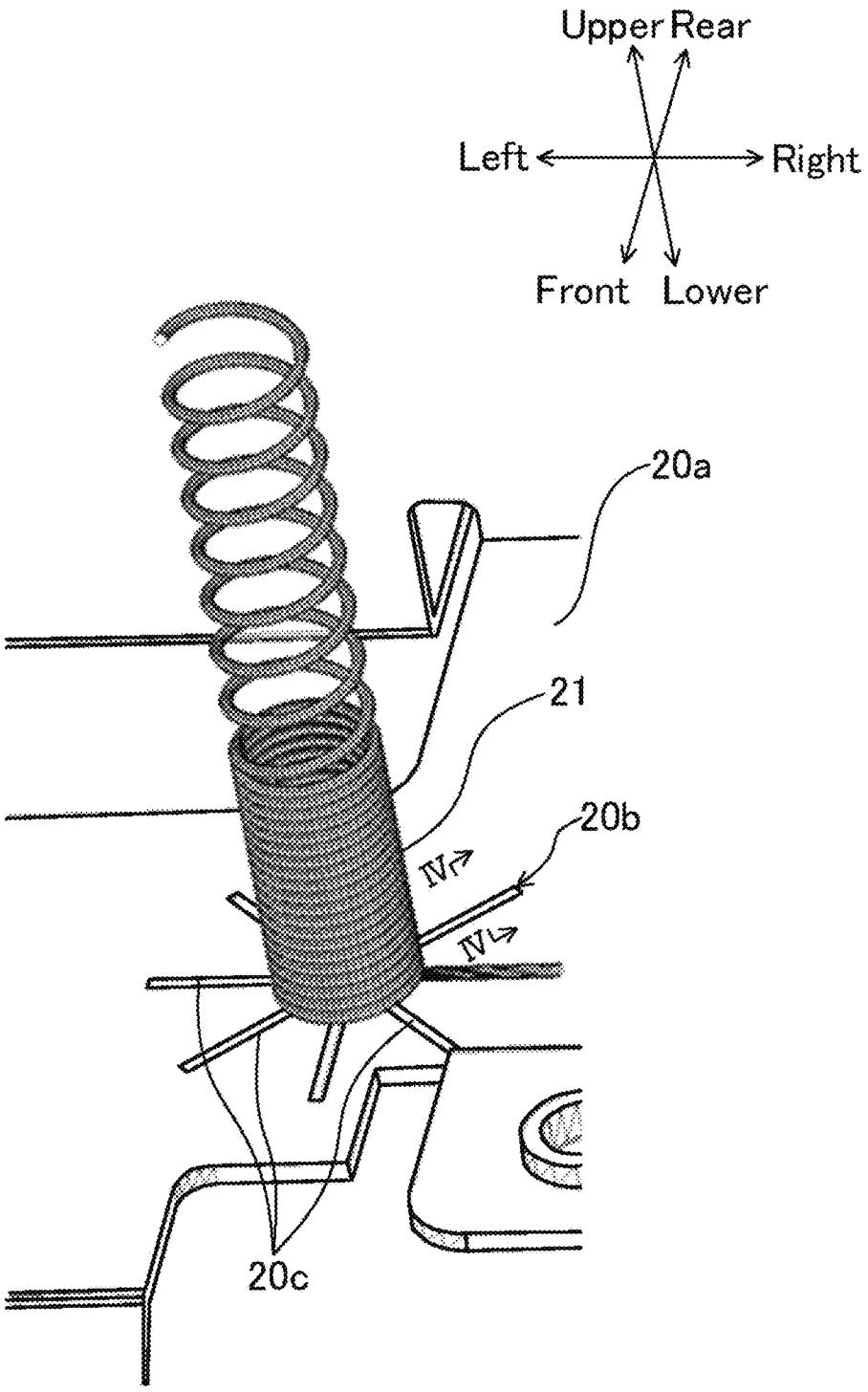
FIG. 3 is a perspective view when a coil spring set on an upper wall metal plate of a body housing is viewed from an obliquely upper side.

FIG. 3 is a view when abutting points between the coil spring 21 and the upper wall metal plate 20*a* of the body housing 20 are viewed from an obliquely upper side. The upper wall metal plate 20*a* is configured with a metal plate member (for example, a SGCC) as described above. At the abutting points between the upper wall metal plate 20*a* and the coil spring 21, an engraved groove 20*b* is formed. The engraved groove 20*b* has a radial shape widened from the central vicinity of the coil spring 21 to a radial outside of the coil spring 21 when viewed from above (when viewed from the scanner housing 18 side). The engraved groove 20*b* includes a plurality of (8 in the present embodiment) groove parts 20*c* extending from the central vicinity of the coil spring 21. Preferably, the engraved groove 20*b* is formed when a worker strikes a marking punch by a hammer and the like. In this way, since it is not necessary to use an expensive device for forming the engraved groove 20*b*, it is possible to reduce the product cost.

Although not illustrated in the drawings, an engraved groove having a similar configuration may be formed at an abutting point of the bottom wall metal plate 18*a* of the scanner housing 18 with respect to the coil spring 21.

Figure 4:
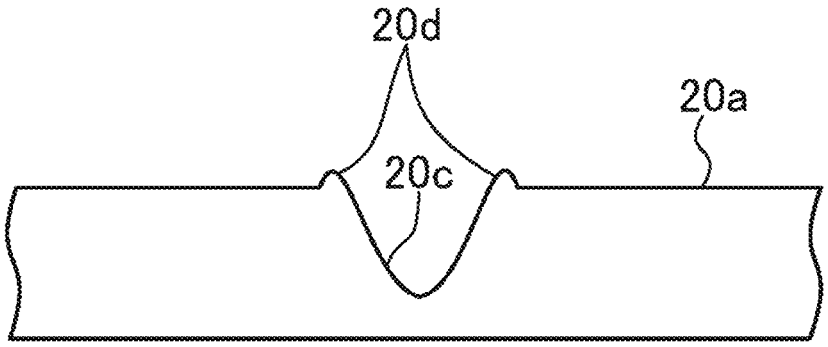
FIG. 4 is a sectional view taken along line IV-IV of FIG. 3.

FIG. 4 is a transversal sectional view of the groove part 20*c* of the engraved groove 20*b*. As illustrated in FIG. 4, the groove part 20*c* is formed, so that both side edges of the groove part 20*c* swell up in a convex shape to form a burr part 20*d*. The burr part 20*d* breaks a protective film of a surface of the upper wall metal plate 20*a* and is exposed to an exterior.

Consequently, according to the grounding structure in the present embodiment, the lower end of the coil spring 21 abuts the burr part 20*d* exposed from the surface of the upper wall metal plate 20*a*. Consequently, it is possible to prevent conduction failure from occurring due to unstable resistance between the coil spring 21 and the upper wall metal plate 20*a* caused by interlayer resistance of the upper wall metal plate 20*a*. Thus, it is not necessary to remove the protective film of the surface of the upper wall metal plate 20*a* by grinding and the like. Thus, it is not necessary to use an expensive grinding device, so that it is possible to reduce the product cost.

Furthermore, in the present embodiment, the lower end surface of the coil spring 21 is the non-grinding surface. In this way, it is possible to further reduce the product cost. That is, in the present embodiment, conductivity between the coil spring 21 and the upper wall metal plate 20*a* increases, so that it is possible to solve conduction failure without removing a protective film of an end part of the coil spring 21 by grinding. Thus, it is possible to reduce the product cost as compared with a case of grinding the other end surface of the coil spring 21.

Furthermore, in the present embodiment, the engraved groove 20*b* has a radial shape widened from the central vicinity of the coil spring 21 to the radial outside of the coil spring 21 when viewed from above.

According to such a configuration, even though the position of the coil spring 21 is slightly shifted in a radial direction, it is possible to keep an abutting state between the coil spring 21 and the burr part 20*d* of the engraved groove 20*b*. Thus, it is possible to suppress conduction failure between the coil spring 21 and the upper wall metal plate 20*a*.

Moreover, in the present embodiment, a similar marking is performed at an abutting point of the bottom wall metal plate 18*a* of the scanner housing 18 with the upper end of the coil spring 21. Consequently, it is also possible to prevent conduction failure between the coil spring 21 and the bottom wall metal plate 18*a*.

Embodiment 2

Figure 5:
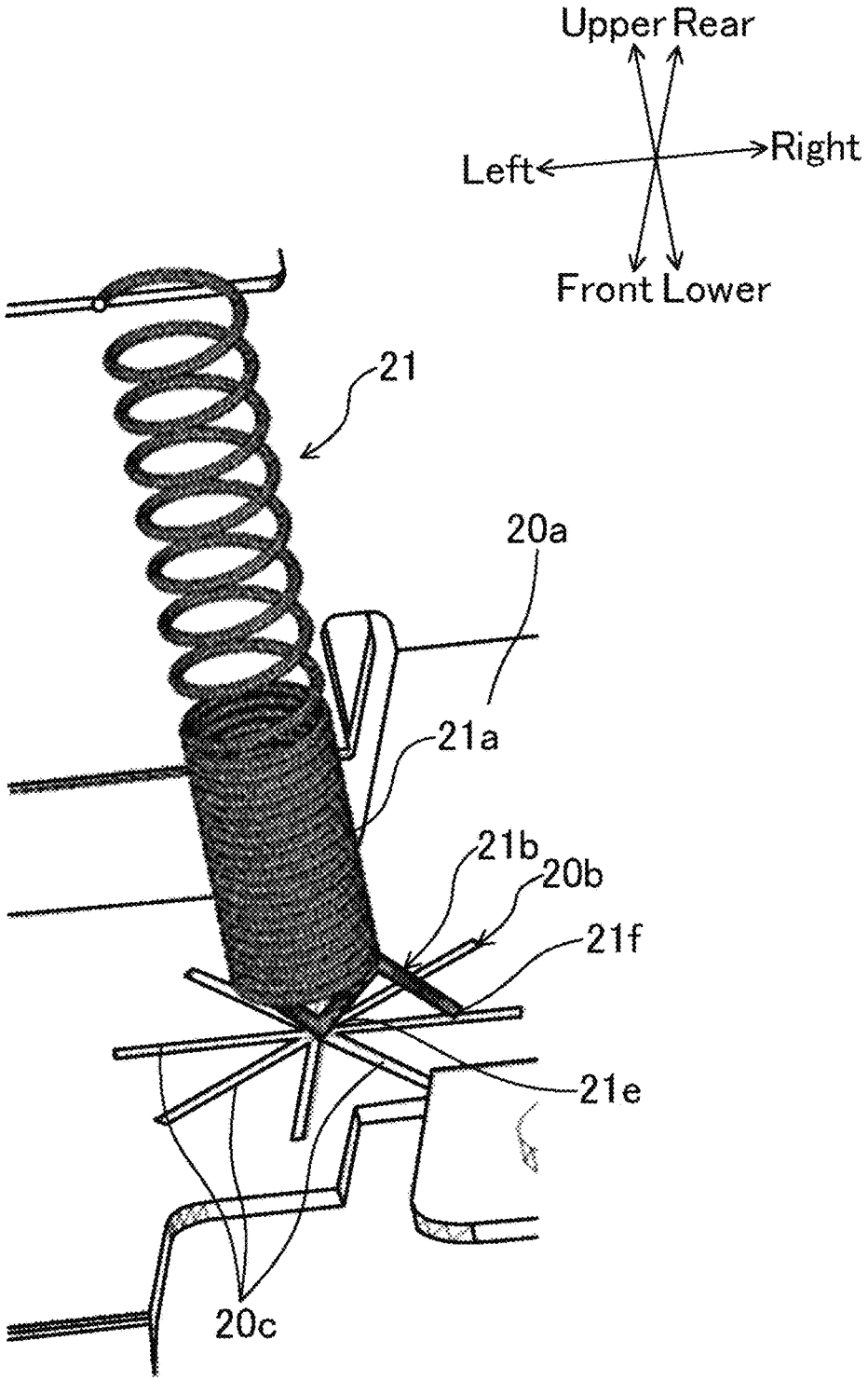
FIG. 5 is a view corresponding to FIG. 3, which illustrates an embodiment 2.

FIG. 5 illustrates an embodiment 2. The present embodiment is different from the embodiment 1 in terms of the shape of the coil spring 21. The same reference numerals are used to designate the same elements as those of FIG. 3 and a detailed description thereof will be omitted.

That is, in the present embodiment, the coil spring 21 is provided at the other end part thereof with a bending part 21*b*. Specifically, the coil spring 21 includes a coiled part 21*a* extending in a coil shape around a shaft line extending in an up and down direction, and the bending part 21*b* connected to a lower end of the coiled part 21*a*. The bending part 21*b* has a shape obtained by bending a linear spring material in a zigzag shape. The bending part 21*b* has a V-shaped part 21*c* (see FIG. 6A) having one end connected to the lower end of the coiled part 21*a* and an inclined linear part 21*d* connected to the other end of the V-shaped part 21*c*. The V-shaped part 21*c* is inclined downward toward a radial inside from the lower end of the coiled part 21*a*, reaches a coil center part, is inclined upward toward a radial outside, and then extends directly under an outer peripheral edge of the coiled part 21*a*. The inclined linear part 21*d* is inclined downward toward a radial outside from the other end of the V-shaped part 21*c*. A top 21*e* of the V-shaped part 21*c* and a distal end part of the inclined linear part 21*d* abut the upper wall metal plate 20*a* of the body housing 20. In the present embodiment, the bending part 21*b* is provided only at the lower end side of the coiled part 21*a*; however, the bending part 21*b* may be provided at the upper end side thereof.

Figure 6A:
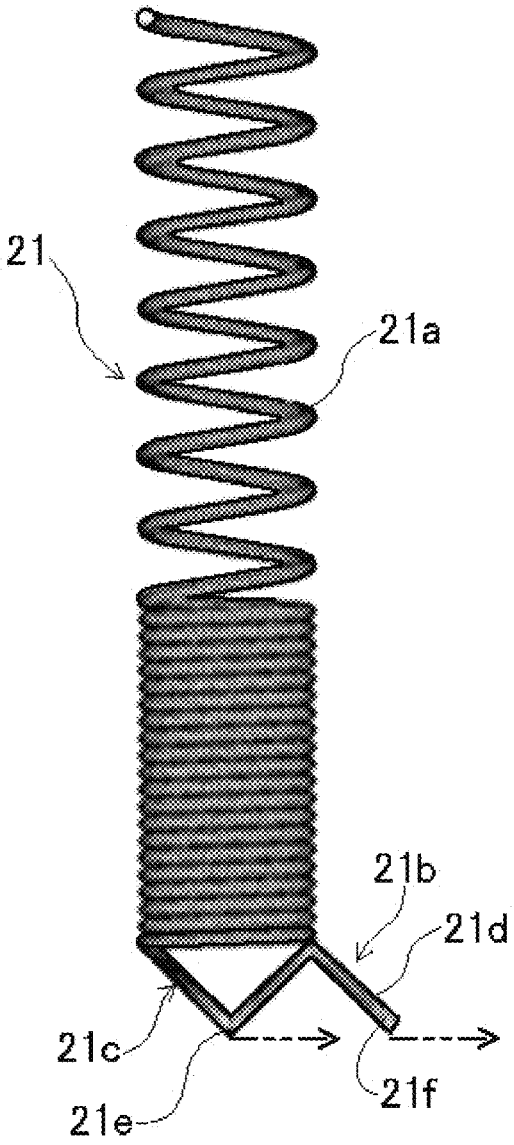
FIG. 6A is an explanation view for explaining the principle in which a protective film of a metal plate member is ground by a bending part of a coil spring when the coil spring is assembled in a grounding structure of an embodiment 2, and is a view illustrating a state before the coil spring is assembled.
Figure 6B:
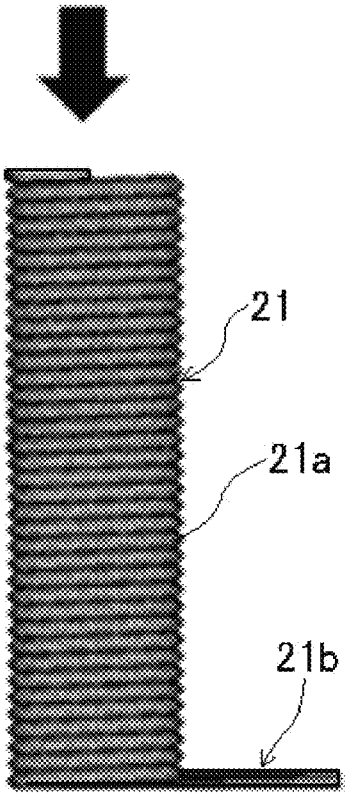
FIG. 6B is an explanation view for explaining the principle in which a protective film of a metal plate member is ground by a bending part of a coil spring when the coil spring is assembled in a grounding structure of an embodiment 2, and is a view illustrating a state after the coil spring is assembled.

According to the grounding structure using the coil spring 21 of the present embodiment, when the coil spring 21 is set between the upper wall metal plate 20*a* of the body housing 20 and the bottom wall metal plate 18*a* of the scanner housing 18, since the coil spring 21 is compressed, the bending part 21*b* is pressed downward from the lower end of the coiled part 21*a* and thus is deformed in a linear shape. FIG. 6A illustrates a state before the deformation and FIG. 6B illustrates a state after the deformation. In such a deformation process, the top 21*e* of the V-shaped part 21*c* and the distal end part 21*f* of the inclined linear part 21*d* move in a direction indicated by a tow dot chain line of FIG. 6A while abutting a metal plate member (the upper wall metal plate 20*a* of the body housing 20). In this way, the protective film of the surface of the upper wall metal plate 20*a* is ground by the top 21*e* and the distal end part 21*f*.

Consequently, even though the formation of the burr part 20*d* of the end edge of the engraved groove 20*b* is not sufficient, a burr part is formed by the movement of the top 21*e* and the distal end part 21*f*, so that it is easy to ensure conductivity between the coil spring 21 and the upper wall metal plate 20*a*.

In the example of FIG. 5, the distal end part 21*f* is allowed to be engaged with the groove part 20*c* of the engraved groove 20*b*, so that it is possible to prevent the bending part 21*b* from horizontally falling when the bending part 21*b* is deformed from a zigzag shape to a linear shape. Thus, it is possible to prevent a grinding effect of a protective film by the top 21*e* and the distal end part 21*f* from being damaged by the horizontal falling of the bending part 21*b*.

The distal end part 21*f* may not be engaged with the groove part 20*c* and may be allowed to be positioned between two adjacent groove parts 20*c*. In this way, a new burr part may be formed at a position different from that of the burr part 20*d* at both side end edges of the groove part 20*c*. Thus, the number of burr part 20*d* contacting with the coil spring 21 is increased, so that it is possible to further improve conductivity between the coil spring 21 and the upper wall metal plate 20*a*.

Modification Example

Figure 7:
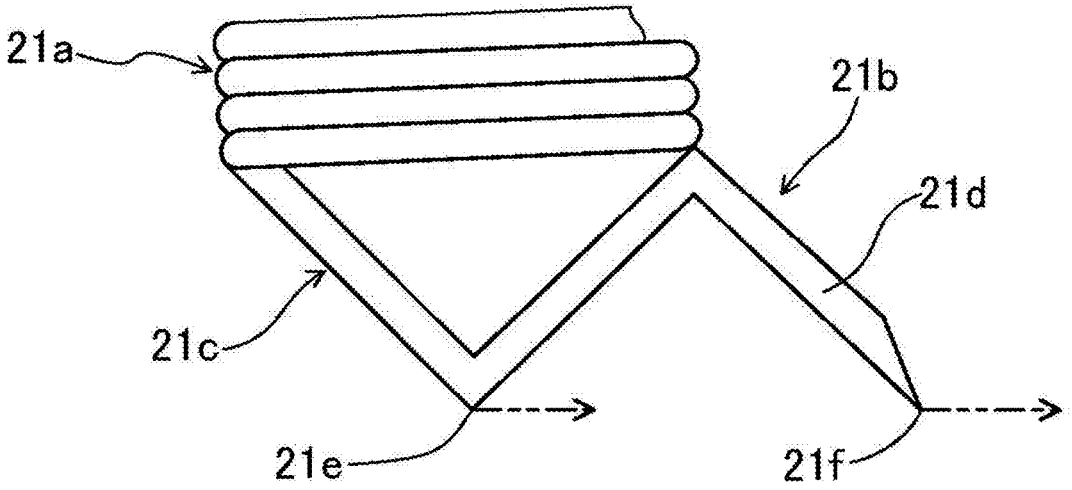
FIG. 7 is a side view illustrating a schematic shape of a bending part of a coil spring in a modification example of an embodiment 2, and is a view corresponding to FIG. 6A.

FIG. 7 illustrates a modification example of the embodiment 2. In the present modification example, the shape of the bending part 21*b* of the coil spring 21 is different from that of the embodiment 2. That is, in the present modification example, the distal end part 21*f* of the inclined linear part 21*d* of the bending part 21*b* is sharpened. According to such a configuration, it is possible to further enhance the grinding effect of the protective film by the distal end part 21*f*.

Other Embodiments

In the aforementioned embodiments, both the first member (the bottom wall metal plate 18*a*) of the equipment side and the second member (the upper wall metal plate 20*a*) of the ground side are configured with a metal plate member; however, the technology of the present disclosure is not limited thereto and the first member of the equipment side may be an electronic board and the like.

In the aforementioned embodiments, an example, in which the engraved groove 20*b* has a radial shape, has been described; however, the technology of the present disclosure is not limited thereto. The engraved groove 20*b* may have any shapes as long as at least a part of the convex burr part 20*d* generated along the end edge of the engraved groove 20*b* has a shape abutting the other end of the coil spring 21.

In the aforementioned embodiments, an example, in which a worker forms the engraved groove 20*b* by using a marking punch, has been described; however, the technology of the present disclosure is not limited thereto and the engraved groove 20*b* may be formed by pressing an engraving die by a press machine or may be formed by laser machining.

As described above, the present invention is available for a grounding structure for electrically grounding an equipment and an image forming apparatus including the same.

What is claimed is:

1. A grounding structure of an equipment, comprising:

a coil spring provided between a first member of an equipment side and a second member, which includes a metal plate member, of a ground side, the first member and the second member being disposed opposite to each other, one end of the coil spring being brought into press contact with the first member and the other end of the coil spring being brought into press contact with the second member, wherein an engraved groove is formed at an abutting point of the second member with the coil spring, and the engraved groove is formed such that at least a part of a convex burr part generated along an end edge of the engraved groove abuts the other end of the coil spring.

2. The grounding structure of the equipment of claim 1, wherein a surface of a side of the other end of the coil spring is a non-grinding surface.

3. The grounding structure of the equipment of claim 1, wherein an end part of the other end of the coil spring has a bending part obtained by bending a material of the coil spring in a zigzag shape, and when the coil spring is set between the first member and the second member, the coil spring is compressed and the bending part is pressed to the coil spring and is deformed in a linear shape, so that an abutting point of the bending part with the second member grinds a protective film of a surface of the second member.

4. The grounding structure of the equipment of claim 3, wherein a distal end part of the bending part is sharpened to abut the surface of the second member.

5. The grounding structure of the equipment of claim 1, wherein the engraved groove has a radial shape widened from a central vicinity of the coil spring to a radial outside of the coil spring when viewed from a side of the first member.

6. The grounding structure of the equipment of claim 1, wherein the first member also includes a metal plate member, and an engraved groove having a same configuration as a configuration of the engraved groove is formed at an abutting point of the first member with one end of the coil spring.

7. An image forming apparatus comprising the grounding structure of the equipment of claim 1.

* * * * *